US006481209B1

(12) United States Patent
Johnson et al.

(10) Patent No.: US 6,481,209 B1
(45) Date of Patent: Nov. 19, 2002

(54) METHODS AND APPARATUS FOR DECREASING COMBUSTOR EMISSIONS WITH SWIRL STABILIZED MIXER

(75) Inventors: Arthur Wesley Johnson, Cincinnati, OH (US); Robert Andrew Wade, Dearborn, MI (US); Hukam Chand Mongia, West Chester; David Louis Burrus, Cincinnati, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/604,986

(22) Filed: Jun. 28, 2000

(51) Int. Cl.[7] ..... F02C 7/228
(52) U.S. Cl. ..... 60/746; 60/750
(58) Field of Search ..... 60/737, 746, 748, 60/750, 751

(56) References Cited

U.S. PATENT DOCUMENTS 3,995,422 A 12/1976 Stamm
4,374,466 A 2/1983 Sotheran
5,619,885 A 4/1997 Kawano et al.
5,791,148 A * 8/1998 Burrus ..... 60/750
6,286,298 B1 9/2001 Burrus et al.
6,295,801 B1 * 10/2001 Burrus et al. ..... 60/750

FOREIGN PATENT DOCUMENTS

EP 0491478 A1 6/1992

* cited by examiner

*Primary Examiner*—Louis J. Casaregola
(74) *Attorney, Agent, or Firm*—William Scott Andes; Armstrong Teasdale LLP

(57) ABSTRACT

A combustor for a gas turbine engine operates with high combustion efficiency, and low carbon monoxide and nitrous oxide emissions during low, intermediate, and high engine power operations. The combustor includes a fuel delivery system that includes at least two fuel stages, at least one trapped vortex cavity, and at least one mixer assembly radially inward from the trapped vortex cavity. The two fuel stages include a pilot fuel circuit that supplies fuel to the trapped vortex cavity through a fuel injector assembly and a main fuel circuit that also supplies fuel to the mixer assembly with the fuel injector assembly.

14 Claims, 4 Drawing Sheets

METHODS AND APPARATUS FOR DECREASING COMBUSTOR EMISSIONS WITH SWIRL STABILIZED MIXER

THIS INVENTION HEREIN DESCRIBED WAS MADE WITH GOVERNMENT SUPPORT UNDER CONTRACT F33615-93-C-2305, AWARDED BY THE ARMY. THE GOVERNMENT HAS CERTAIN RIGHTS IN THIS INVENTION.

BACKGROUND OF THE INVENTION

This application relates generally to combustors and, more particularly, to gas turbine combustors.

Air pollution concerns worldwide have led to stricter emissions standards both domestically and internationally. Aircraft are governed by both Environmental Protection Agency (EPA) and International Civil Aviation Organization (ICAO) standards. These standards regulate the emission of oxides of nitrogen (NOx), unburned hydrocarbons (HC), and carbon monoxide (CO) from aircraft in the vicinity of airports, where they contribute to urban photochemical smog problems. Most aircraft engines are able to meet current emission standards using combustor technologies and theories proven over the past 50 years of engine development. However, with the advent of greater environmental concern worldwide, there is no guarantee that future emissions standards will be within the capability of current combustor technologies.

In general, engine emissions fall into two classes: those formed because of high flame temperatures (NOx), and those formed because of low flame temperatures which do not allow the fuel-air reaction to proceed to completion (HC & CO). A small window exists where both pollutants are minimized. For this window to be effective, however, the reactants must be well mixed, so that burning occurs evenly across the mixture without hot spots, where NOx is produced, or cold spots, when CO and HC are produced. Hot spots are produced where the mixture of fuel and air is near a specific ratio when all fuel and air react (i.e. no unburned fuel or air is present in the products). This mixture is called stoichiometric. Cold spots can occur if either excess air is present (called lean combustion), or if excess fuel is present (called rich combustion).

Modern gas turbine combustors consist of between 10 and 30 mixers, which mix high velocity air with a fine fuel spray. These mixers usually consist of a single fuel injector located at a center of a swirler for swirling the incoming air to enhance flame stabilization and mixing. Both the fuel injector and mixer are located on a combustor dome.

In general, the fuel to air ratio in the mixer is rich. Since the overall combustor fuel-air ratio of gas turbine combustors is lean, additional air is added through discrete dilution holes prior to exiting the combustor. Poor mixing and hot spots can occur both at the dome, where the injected fuel must vaporize and mix prior to burning, and in the vicinity of the dilution holes, where air is added to the rich dome mixture.

Properly designed, rich dome combustors are very stable devices with wide flammability limits and can produce low HC and CO emissions, and acceptable NOx emissions. However, a fundamental limitation on rich dome combustors exists, since the rich dome mixture must pass through stoichiometric or maximum NOx producing regions prior to exiting the combustor. This is particularly important because as the operating pressure ratio (OPR) of modern gas turbines increases for improved cycle efficiencies and compactness, combustor inlet temperatures and pressures increase the rate of NOx production dramatically. As emission standards become more stringent and OPR's increase, it appears unlikely that traditional rich dome combustors will be able to meet the challenge.

One state-of-the-art lean dome combustor is referred to as a dual annular combustor (DAC) because it includes two radially stacked mixers on each fuel nozzle which appear as two annular rings when viewed from the front of a combustor. The additional row of mixers allows tuning for operation at different conditions. At idle, the outer mixer is fueled, which is designed to operate efficiently at idle conditions. At higher powers, both mixers are fueled with the majority of fuel and air supplied to the inner annulus, which is designed to operate most efficiently and with few emissions at higher powers. While the mixers have been tuned for optimal operation with each dome, the boundary between the domes quenches the CO reaction over a large region, which makes the CO of these designs higher than similar rich dome single annular combustors (SACs). Such a combustor is a compromise between low power emissions and high power NOx.

Other known designs alleviate the problems discussed above with the use of a lean dome combustor. Instead of separating the pilot and main stages in separate domes and creating a significant CO quench zone at the interface, the mixer incorporates concentric, but distinct pilot and main air streams within the device. However, the simultaneous control of low power CO/HC and smoke emission is difficult with such designs because increasing the fuel/air mixing often results in high CO/HC emissions. The swirling main air naturally tends to entrain the pilot flame and quench it. To prevent the fuel spray from getting entrained into the main air, the pilot establishes a narrow angle spray. This results in a long jet flames characteristic of a low swirl number flow. Such pilot flames produce high smoke, carbon monoxide, and hydrocarbon emissions and have poor stability.

BRIEF SUMMARY OF THE INVENTION

In an exemplary embodiment, a combustor for a gas turbine engine operates with high combustion efficiency and low carbon monoxide, nitrous oxide, and smoke emissions during low, intermediate, and high engine power operations. The combustor includes a fuel delivery system that includes at least two fuel stages, at least one trapped vortex cavity, and at least one mixer assembly radially inward from the trapped vortex cavity. The two fuel stages include a pilot fuel circuit that supplies fuel to the trapped vortex cavity through a fuel injector assembly and a main fuel circuit that also supplies fuel to the mixer assembly with the fuel injector assembly.

During low power operation, the combustor operates using only the pilot fuel circuit and fuel is supplied to the trapped vortex cavity. Combustion gases generated within the trapped vortex cavity swirl and stabilize the mixture prior to the mixture entering a combustion chamber. Because the mixture is stabilized during low power operation, combustor operating efficiency is maintained and emissions are controlled. During increased power operation, the combustor operates using the main fuel circuit and fuel is supplied to the trapped vortex cavity and the mixer assembly. The mixer assembly disperses fuel evenly throughout the combustor to increase the mixing of fuel and air, thus reducing flame temperatures within the combustion chamber. As a result, a combustor is provided which operates with a high combustion efficiency while controlling and maintaining low carbon monoxide, nitrous oxide, and smoke emissions during engine low, intermediate, and high power operations.

DETAILED DESCRIPTION OF THE INVENTION

Figure 1:
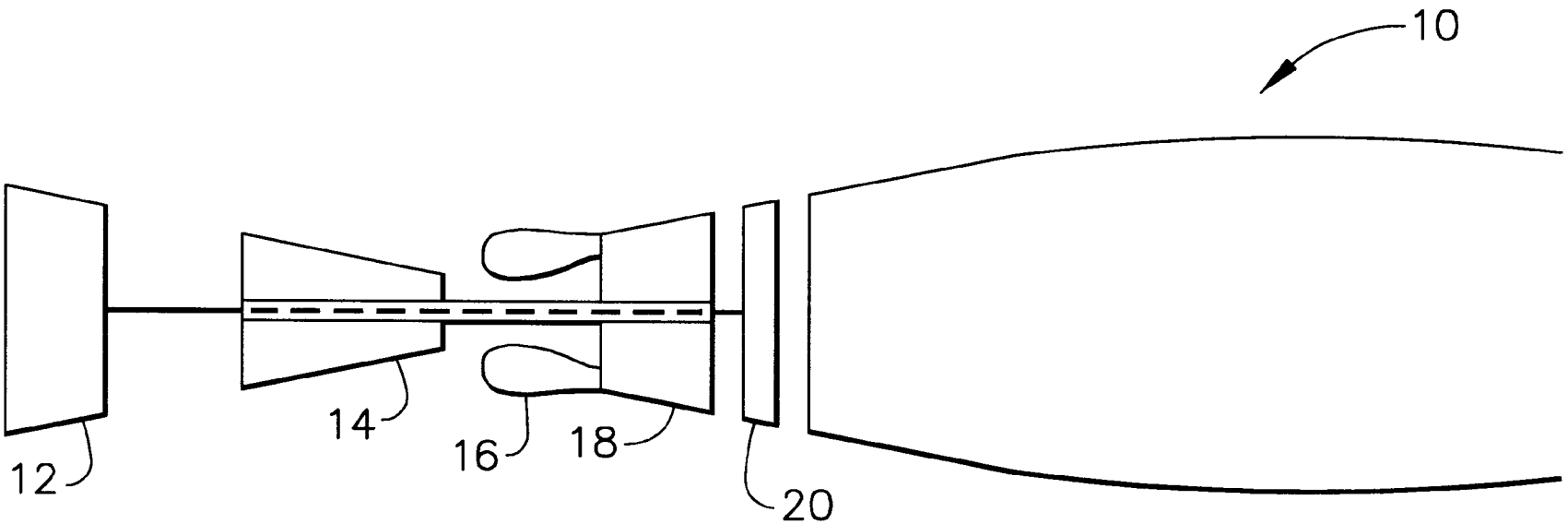
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20.

Figure 2:
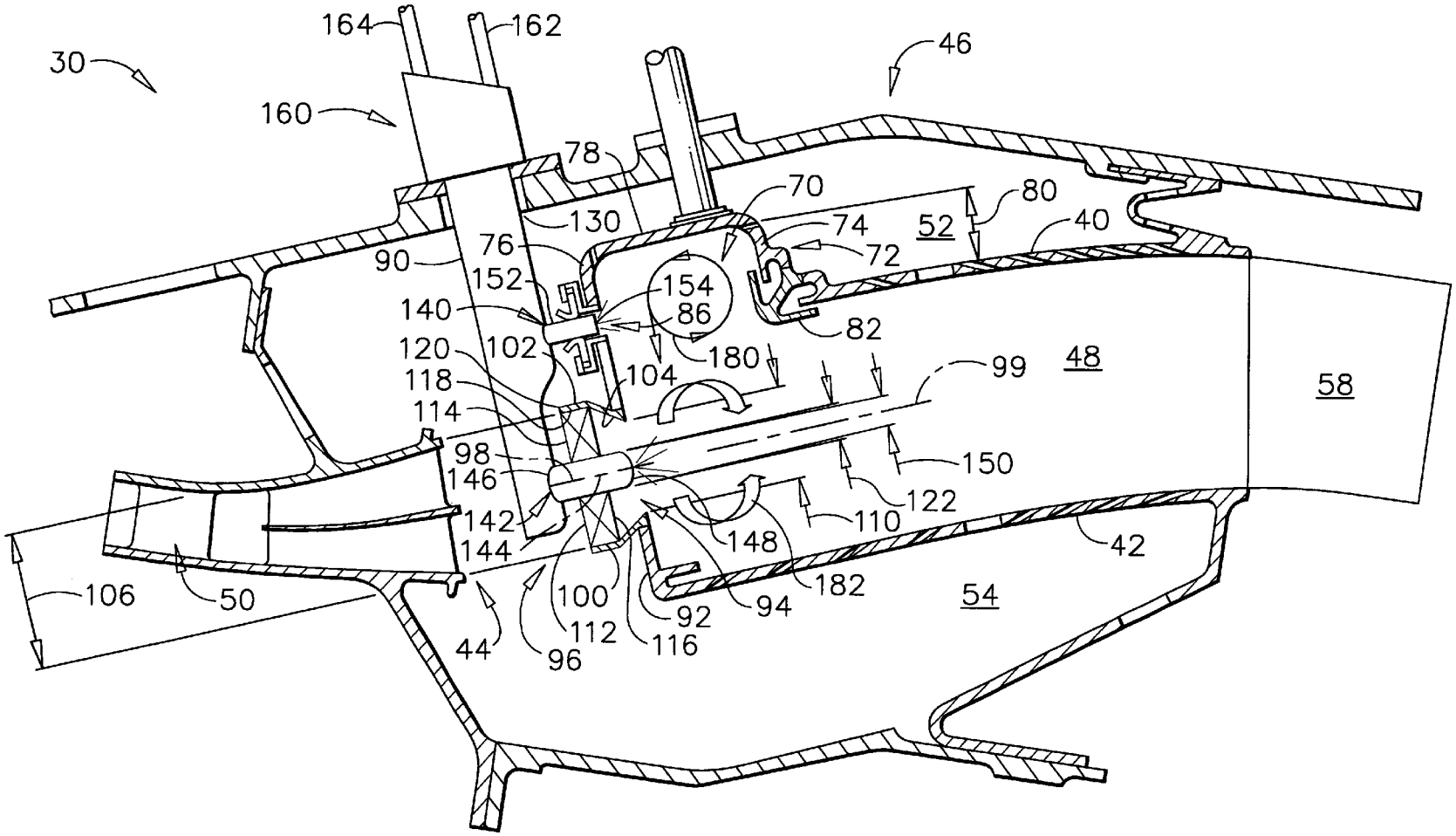
FIG. 2 is a cross-sectional view of a combustor used with the gas turbine engine shown in FIG. 1.

FIG. 2 is a cross-sectional view of a combustor 30 for use with a gas turbine engine, similar to engine 10 shown in FIG. 1. In one embodiment, the gas turbine engine is a GE F414 engine available from General Electric Company, Cincinnati, Ohio. Combustor 30 includes an annular outer liner 40, an annular inner liner 42, and a domed inlet end 44 extending between outer and inner liners 40 and 42, respectively. Domed inlet end 44 has a shape of a low area ratio diffuser.

Outer liner 40 and inner liner 42 are spaced radially inward from a combustor casing 46 and define a combustion chamber 48. Combustor casing 46 is generally annular and extends downstream from an exit 50 of a compressor, such-as compressor 14 shown in FIG. 1. Combustion chamber 48 is generally annular in shape and is disposed radially inward from liners 40 and 42. Outer liner 40 and combustor casing 46 define an outer passageway 52 and inner liner 42 and combustor casing 46 define an inner passageway 54. Outer and inner liners 40 and 42, respectively, extend to a turbine inlet nozzle 58 disposed downstream from diffuser 48.

A trapped vortex cavity 70 is incorporated into a portion 72 of outer liner 40 immediately downstream of dome inlet end 44. Trapped vortex cavity 70 has a rectangular cross-sectional profile and because trapped vortex cavity 70 opens into combustion chamber 48, cavity 70 only includes an aft wall 74, an upstream wall 76, and an outer wall 78 extending between aft wall 74 and upstream wall 76. In an alternative embodiment, trapped vortex cavity 70 has a non-rectangular cross-sectional profile. In a further alternative embodiment, trapped vortex cavity 70 includes rounded corners. Outer wall 78 is substantially parallel to outer liner 40 and is radially outward a distance 80 from outer liner 40. A corner bracket 82 extends between trapped vortex cavity aft wall 74 and combustor outer liner 40 and secures aft wall 74 to outer liner 40. Trapped vortex cavity upstream wall 76, aft wall 74, and outer wall 78 each include a plurality of passages (not shown) and openings (not shown) to permit air to enter trapped vortex cavity 70.

Trapped vortex cavity upstream wall 76 also includes an opening 86 sized to receive a fuel injector assembly 90. Fuel injector assembly 90 extends radially inward through combustor casing 46 upstream from a combustion chamber upstream wall 92 defining combustion chamber 48. Combustion chamber upstream wall 92 extends between combustor inner liner 42 and trapped vortex cavity upstream wall 76 and includes an opening 94. Combustion chamber upstream wall 92 is substantially co-planar with trapped vortex cavity upstream wall 76, and substantially perpendicular to combustor inner liner 42.

Combustor upstream wall opening 94 is sized to receive a mixer assembly 96. Mixer assembly 96 is attached to combustion chamber upstream wall 92 such that a mixer assembly axis of symmetry 98 is substantially co-axial with an axis of symmetry 99 for combustion chamber 48. Mixer assembly 96 is generally cylindrical-shaped with an annular cross-sectional profile (not shown) and includes an outer wall 100 that includes an upstream portion 102 and a downstream portion 104.

Mixer assembly outer wall upstream portion 102 is substantially cylindrical and has a diameter 106 sized to receive fuel injector assembly 90. Mixer assembly outer wall downstream portion 104 extends from upstream portion 102 to combustor upstream wall opening 94 and converges towards mixer assembly axis of symmetry 98. Accordingly, a diameter 110 of upstream wall opening 94 is less than upstream portion diameter 106.

Mixer assembly 96 also includes a swirler 112 extending circumferentially within mixer assembly 96. Swirler 112 includes an intake side 114 and an outlet side 116. Swirler 112 is positioned adjacent an inner surface 118 of mixer assembly outer wall upstream portion 102 such that swirler intake side 114 is substantially co-planar with a leading edge 120 of mixer assembly outer wall upstream portion 102. Swirler 112 has an inner diameter 122 sized to receive fuel injector assembly 90. In one embodiment, swirlers 112 are single axial swirlers. In an alternative embodiment, swirlers 112 are radial swirlers Fuel injector assembly 90 extends radially inward into combustor 16 through an opening 130 in combustor casing 46. Fuel injector assembly 90 is positioned between domed inlet end 44 and mixer assembly 96 and includes a pilot fuel injector 140 and a main fuel injector 142. Main fuel injector 142 is radially inward from pilot fuel injector 140 and is positioned within mixer assembly 96 such that a main fuel injector axis of symmetry 144 is substantially co-axial with mixer assembly axis of symmetry 98. Specifically, main fuel injector 142 is positioned such that an intake side 146 of main fuel injector 142 is upstream from mixer assembly 96 and a trailing end 148 of main fuel injector 142 extends through mixer assembly 96 radially inward from swirler 112 and towards combustor upstream wall opening 94. Accordingly, main fuel injector 142 has a diameter 150 that is slightly less than swirler inner diameter 122.

Pilot fuel injector 140 is radially outward from main fuel injector 142 and is positioned upstream from trapped vortex cavity upstream wall opening 86. Specifically, pilot fuel injector 140 is positioned such that a trailing end 154 of pilot fuel injector 140 is in close proximity to opening 86.

A fuel delivery system 160 supplies fuel to combustor 30 and includes a pilot fuel circuit 162 and a main fuel circuit 164 to control nitrous oxide emissions generated within combustor 30. Pilot fuel circuit 162 supplies fuel to trapped vortex cavity 70 through fuel injector assembly 90 and main fuel circuit 164 supplies fuel to mixer assembly 96 through fuel injector assembly 90. During operation, as gas turbine engine 10 is started and operated at idle operating conditions, fuel and air are supplied to combustor 30. During gas turbine idle operating conditions, combustor 30 uses only the pilot fuel stage for operating. Pilot fuel circuit 162 injects fuel to combustor trapped vortex cavity 70 through pilot fuel injector 140. Simultaneously, airflow enters trapped vortex cavity 70 through aft, upstream, and outer wall air passages and enters mixer assembly 96 through swirlers 112. The trapped vortex cavity air passages form a collective sheet of air that mixes rapidly with the fuel injected and prevents the fuel from forming a boundary layer along aft wall 74, upstream wall 76, or outer wall 78.

Combustion gases 180 generated within trapped vortex cavity 70 swirl in a counter-clockwise motion and provide a continuous ignition and stabilization source for the fuel/air mixture entering combustion chamber 48. Airflow 182 entering combustion chamber 48 through mixer assembly swirler 112 increases a rate of fuel/air mixing to enable substantially near-stoichiometric flame-zones (not shown) to propagate with short residence times within combustion chamber 48. As a result of enhanced mixing and the short bulk residence times within combustion chamber 48, nitrous oxide emissions generated within combustion chamber 48 are reduced.

Utilizing only the pilot fuel stage permits combustor 30 to maintain low power operating efficiency and to control and minimize emissions exiting combustor 30 during engine low power operations. The pilot flame is a spray diffusion flame fueled entirely from gas turbine start conditions. As gas turbine engine 10 is accelerated from idle operating conditions to increased power operating conditions, additional fuel and air are directed into combustor 30. In addition to the pilot fuel stage, during increased power operating conditions, mixer assembly 96 is supplied fuel with the main fuel stage through fuel injector assembly 90 and main fuel circuit 164.

Airflow 182 entering combustion chamber 48 from mixer assembly swirler 112 swirls around fuel injected into combustion chamber 48 to permit fuel/air mixture to thoroughly mix. Swirling airflow 182 increases a rate of fuel/air mixing of fuel and air entering combustion chamber 48 through mixer assembly 96 and fuel and air entering combustion chamber 48 through trapped vortex cavity 70. As a result of the increased fuel/air mixing rates, combustion is improved and combustor 30 may be operated using fewer fuel injector assemblies 90 in comparison to other known combustors. Furthermore, because the combustion is improved and mixer assembly 96 distributes the fuel evenly throughout combustor 16, flame temperatures within combustion chamber 48 are reduced, thus reducing an amount of nitrous oxide produced within combustor 30. A trapped vortex cavity flame also acts to ignite and stabilize a mixer flame. Thus, mixer assembly 96 is operable at lean fuel/air ratios. As a result, flame temperatures and nitrous oxide generation within mixer assembly 96 are reduced and mixer assembly 96 may be fueled as a lean fuel/air ratio device.

Figure 3:
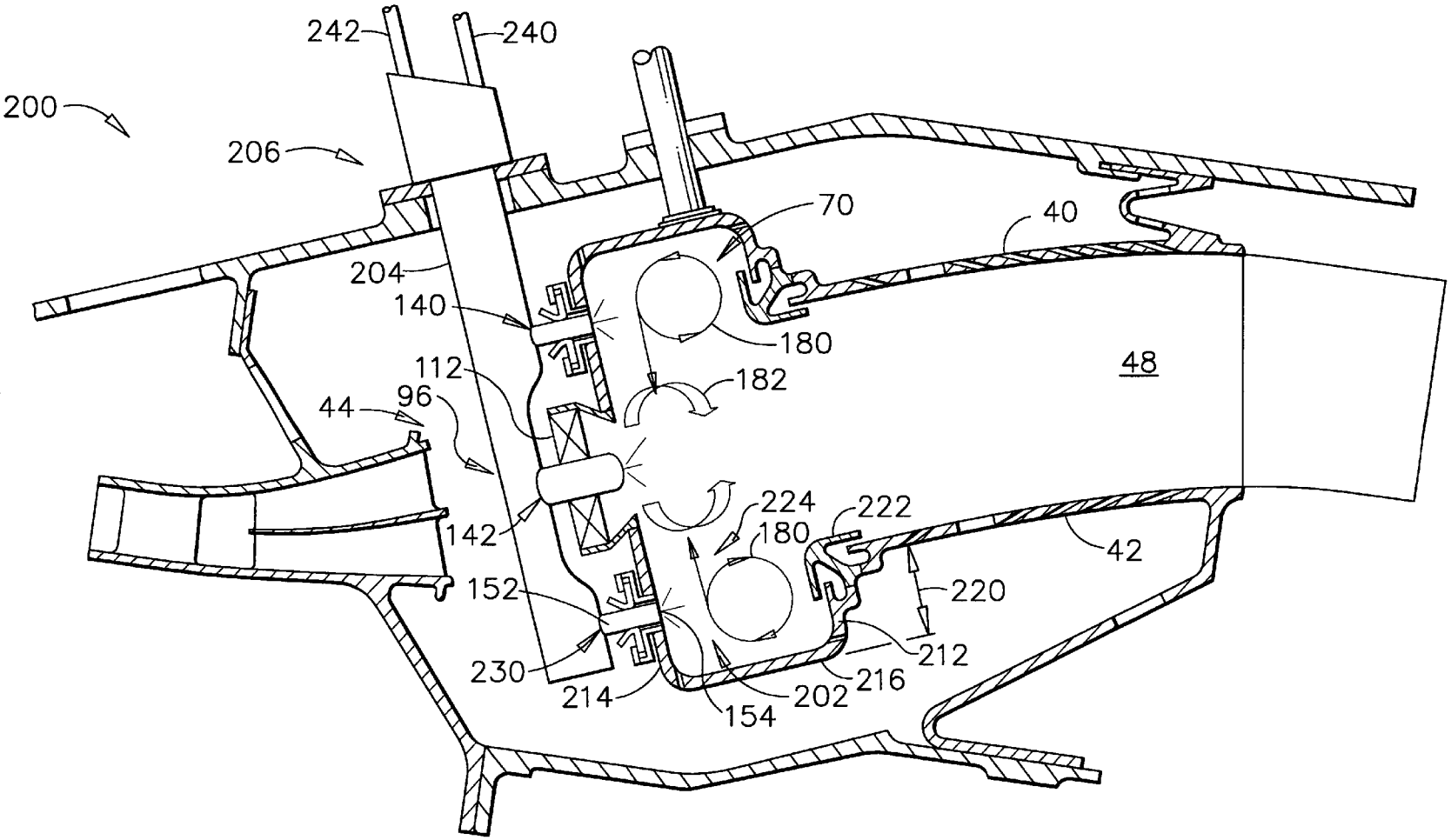
FIG. 3 is a cross-sectional view of an alternative embodiment of the combustor shown in FIG. 2.

FIG. 3 is a cross-sectional view of an alternative embodiment of a combustor 200 that may be used with a gas turbine engine, such as engine 10 shown in FIG. 1. Combustor 200 is substantially similar to combustor 30 shown in FIG. 2 and components in combustor 200 that are identical to components of combustor 30 are identified in FIG. 3 using the same reference numerals used in FIG. 2. Accordingly, combustor 30 includes liners 40 and 42, domed inlet end 44, trapped vortex cavity 70, and mixer assembly 96. Combustor 200 also includes a second trapped vortex cavity 202, a fuel injector assembly 204, and a fuel delivery system 206.

Trapped vortex cavity 202 is incorporated into a portion of inner liner 42 immediately downstream of dome inlet end 44. Trapped vortex cavity 202 is substantially similar to trapped vortex cavity 70 and has a rectangular cross-sectional profile. In an alternative embodiment, trapped vortex cavity 202 has a non-rectangular cross-sectional profile. In a further alternative embodiment, trapped vortex cavity 202 includes rounded corners. Because trapped vortex cavity 202 opens into combustion chamber 48, cavity 202 only includes an aft wall 212, an upstream wall 214, and an outer wall 216 extending between aft wall 212 and upstream wall 214. Outer wall 216 is substantially parallel to inner liner 42 and is radially outward a distance 220 from inner liner 42. A corner bracket 222 extends between trapped vortex cavity aft wall 212 and combustor outer liner 214 and secures aft wall 212 to outer liner 40. Trapped vortex cavity upstream wall 214, aft wall 212, and outer wall 216 each include a plurality of passages (not shown) and openings (not shown) to permit air to enter trapped vortex cavity 202.

Trapped vortex cavity upstream wall 214 also includes an opening 224 sized to receive fuel injector assembly 204. Fuel injector assembly 204 is substantially similar to fuel injector assembly 90 (shown in FIG. 2) and includes pilot fuel injector 140 and main fuel injector 142. Fuel injector assembly 204 also includes a second pilot fuel injector 230 radially inward from main fuel injector 142. Second pilot fuel injector 230 is substantially similar to first pilot fuel injector 140 and is positioned upstream from trapped vortex cavity upstream wall opening 224. Specifically, second pilot fuel injector 230 is positioned such that intake side 152 of second pilot fuel injector 230 is upstream from mixer assembly 96 and trailing end 154 of second pilot fuel injector 230 is in close proximity to opening 224.

Fuel delivery system 206 supplies fuel to combustor 200 and includes a pilot fuel circuit 240 and a main fuel circuit 242. Pilot fuel circuit 240 supplies fuel to trapped vortex cavities 70 and 202 through fuel injector assembly 204 and main fuel circuit 242 supplies fuel to mixer assembly 96 through fuel injector assembly 204. Fuel delivery system 206 also includes a pilot fuel stage and a main fuel stage used to control nitrous oxide emissions generated within combustor 200.

During operation, as gas turbine engine 10 is started and operated at idle operating conditions, fuel and air are supplied to combustor 200. During gas turbine idle operating conditions, combustor 200 uses only the pilot fuel stage for operating. Pilot fuel circuit 240 injects fuel to combustor trapped vortex cavities 70 and 202 through pilot fuel injectors 140 and 230, respectively. Simultaneously, airflow enters trapped vortex cavities 70 and 202 through aft, upstream, and outer wall air passages and enters mixer assembly 96 through swirlers 112. The trapped vortex cavity air passages form a collective sheet of air that mixes rapidly with the fuel injected and prevents the fuel from forming a boundary layer within trapped vortex cavities 70 and 202.

Combustion gases 180 generated within trapped vortex cavities 70 and 202 swirl in a counter-clockwise motion and provide a continuous ignition and stabilization source for the fuel/air mixture entering combustion chamber 48. Airflow 182 entering combustion chamber 48 through mixer assembly swirler 112 increases a rate of fuel/air mixing to enable substantially near-stoichiometric flame-zones (not shown) to propagate with short residence times within combustion chamber 48. As a result of enhanced mixing and the short bulkresidence times within combustion chamber 48, nitrous oxide emissions generated within combustion chamber 48 are reduced.

Utilizing only the pilot fuel stage permits combustor 200 to maintain low power operating efficiency and to control and minimize emissions exiting combustor 200 during engine low power operations. The pilot flame is a spray diffusion flame fueled entirely from gas turbine start conditions. As gas turbine engine 10 is accelerated from idle operating conditions to increased power operating conditions, additional fuel and air are directed into combustor 16. In addition to the pilot fuel stage, during increased power operating conditions, mixer assembly 96 is supplied fuel with the main fuel stage through fuel injector assembly 204 and main fuel circuit 242.

Airflow 182 entering combustion chamber 48 from mixer assembly swirler 112 swirls around fuel injected into combustion chamber 48 to permit fuel/air mixture to thoroughly mix. Swirling airflow 182 increases a rate of fuel/air mixing of fuel and air entering combustion chamber 48 through mixer assembly 96 and fuel and air entering combustion chamber 48 through trapped vortex cavities 70 and 202. As a result of the increased fuel/air mixing rates, combustion is improved and combustor 200 may be operated using fewer fuel injector assemblies 204 in comparison to other known combustors. Furthermore, because the combustion is improved and mixer assembly 96 distributes the fuel evenly throughout combustor 200, flame temperatures within combustion chamber 48 are reduced, thus reducing an amount of nitrous oxide produced within combustor 200. A trapped vortex cavity flame also acts to ignite and stabilize a mixer flame. Thus, mixer assembly 96 is operable at lean fuel/air ratios. As a result, flame temperatures and nitrous oxide generation within mixer assembly 96 are reduced and mixer assembly 96 may be fueled as a lean fuel/air ratio device.

Figure 4:
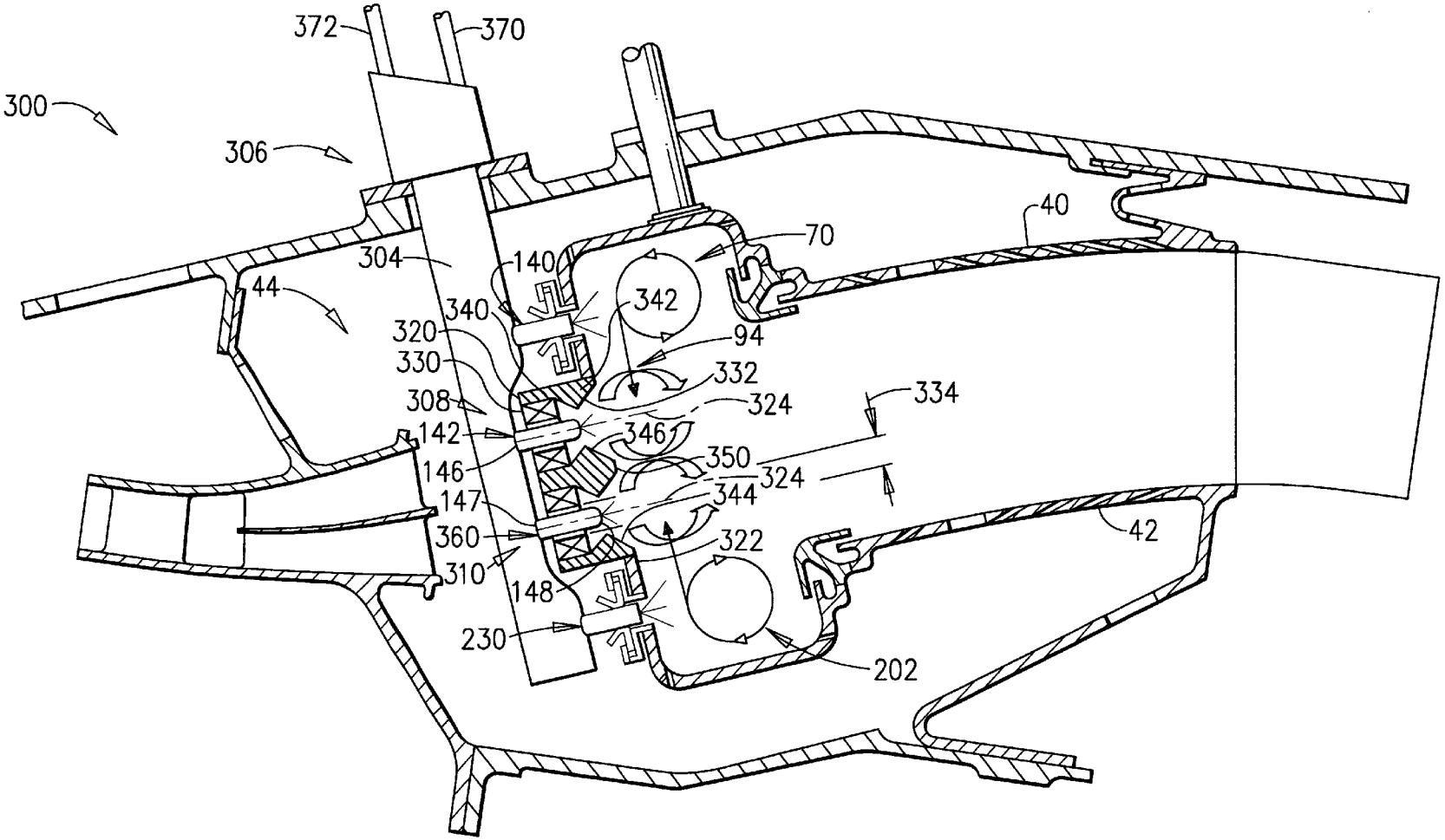
FIG. 4 is a cross-sectional view of a second alternative embodiment of the combustor shown in FIG. 2.

FIG. 4 is a cross-sectional view of an alternative embodiment of a combustor 300 that may be used with a gas turbine engine, such as engine 10 shown in FIG. 1. Combustor 300 is substantially similar to combustor 200 shown in FIG. 3 and components in combustor 300 that are identical to components of combustor 200 are identified in FIG. 4 using the same reference numerals used in FIG. 3. Accordingly, combustor 300 includes liners 40 and 42, domed inlet end 44, and trapped vortex cavity 70. Combustor 300 also includes second trapped vortex cavity 202, a fuel injector assembly 304, a fuel delivery system 306, a first mixer assembly 308, and a second mixer assembly 310.

Combustor upstream wall opening 94 is sized to receive mixer assemblies 308 and 310. Mixer assemblies 308 and 310 are substantially similar to mixer assembly 96 (shown in FIGS. 2 and 3) and each include a leading edge 320, a trailing edge 322, and an axis of symmetry 324. Mixer assemblies 308 and 310 are positioned such that leading edges 320 are substantially co-planar and such that trailing edges 322 are also substantially co-planar. Additionally, mixer assemblies 308 and 310 are attached to combustion chamber upstream wall 92 such that mixer assemblies 308 and 310 are symmetrical about combustion chamber axis of symmetry 99.

Each mixer assembly 308 and 310 also includes a swirler 330 and a venturi 332. Swirlers 330 are substantially similar to swirlers 112 (shown in FIGS. 2 and 3) and have an inner diameter 334 sized to receive fuel injector assembly 304. Swirlers 330 are positioned adjacent mixer assembly venturis 332. In one embodiment, swirlers 330 are single axial swirlers. In an alternative embodiment, swirlers 330 are radial swirlers. Swirlers 330 cause air flowing through mixer assemblies 308 and 310 to swirl to cause fuel and air to mix thoroughly prior to entering combustion chamber 48. In one embodiment, swirlers 330 induce airflow to swirl in a counter-clockwise direction. In another embodiment, swirlers 330 induce airflow to swirl in a clockwise direction. In yet another embodiment, swirlers 330 induce airflow to swirl in counter-clockwise and clockwise directions.

Venturis 332 are annular and are radially outward from swirlers 330. Venturis 332 include a planar section 340, a converging section 342, and a diverging section 344. Planar section 340 is radially outward from and adjacent swirlers 330. Converging section 342 extends radially inward from planar section 340 to a venturi apex 346. Diverging section 344 extends radially outward from venturi apex 346 to a trailing edge 350 of venturi 332. In an alternative embodiment, venturi 332 only includes converging section 342 and does not include diverging section 344.

Fuel injector assembly 304 is substantially similar to fuel injector assembly 204 (shown in FIG. 3) and includes pilot fuel injector 140, main fuel injector 142, and second pilot fuel injector 230. Fuel injector assembly 304 also includes a second main fuel injector 360 radially inward from main fuel injector 142 between main fuel injector 142 and second pilot fuel injector 230.

Second main fuel injector 360 is identical to first main fuel injector 142 and is positioned upstream from combustor upstream wall opening 94 such that second main fuel injector 360 is substantially co-axial with mixer assembly axis of symmetry 324. Specifically, second main fuel injector 360 is positioned such that intake side 147 of second main fuel injector 360 is upstream from mixer assembly 310 and trailing end 148 of second main fuel injector 360 extends through mixer assembly 310 radially inward from swirler 330 and towards combustor upstream wall opening 94.

First main fuel injector 142 is positioned upstream from combustor upstream wall opening 94 such that first main fuel injector 142 is substantially coaxial with mixer assembly axis of symmetry 324. Specifically, first main fuel injector 142 is positioned such that intake side 146 of first main fuel injector 142 is upstream from mixer assembly 308 and trailing end 148 of first main fuel injector 142 extends through mixer assembly 308 radially inward from swirler 330 and towards combustor upstream wall opening 94.

Fuel delivery system 306 supplies fuel to combustor 300 and includes a pilot fuel circuit 370 and a main fuel circuit 372. Pilot fuel circuit 370 supplies fuel to trapped vortex cavities 70 and 202 through fuel injector assembly 304 and main fuel circuit 372 supplies fuel to mixer assemblies 308 and 310 through fuel injector assembly 304. Fuel delivery system 306 also includes a pilot fuel stage and a main fuel stage used to control nitrous oxide emissions generated within combustor 300.

The above-described combustor is cost-effective and highly reliable. The combustor includes at least one mixer assembly, at least one trapped vortex cavity, and a fuel delivery system that includes at least two fuel circuits. During idle power operating conditions, the combustor operates only with one fuel circuit that supplies fuel to the trapped vortex cavity. The pilot fuel stage permits the combustor to maintain low power operating efficiency while minimizing emissions. During increased power operating conditions, the combustor uses both fuel circuits and fuel is dispersed evenly throughout the combustor. As a result, flame temperatures are reduced and combustion is improved. Thus, the combustor with a high combustion efficiency and with low carbon monoxide, nitrous oxide, and smoke emissions.

While the invention has been described in terms of various specific embodiments, those skilled in the art will recognize that the invention can be practiced with modification within the spirit and scope of the claims.

What is claimed is:

1. A combustor for a gas turbine comprising:

a fuel system comprising at least two fuel stages;

at least one trapped vortex cavity, a first of said two fuel stages configured to supply fuel to said trapped vortex cavity;

at least two mixer assemblies radially inward from said trapped vortex cavity, a second of said two fuel stages configured to supply fuel to said at least two mixer assemblies;

a diffuser upstream from said at least two mixer assemblies.

2. A combustor in accordance with claim 1 further comprising at least one fuel injector in flow communication with said fuel system, said fuel injector configured to supply fuel to said trapped vortex cavity and said at least two mixer assemblies.

3. A combustor in accordance with claim 1 wherein the gas turbine engine has a rated power, said fuel system further comprising a pilot fuel circuit and a main fuel circuit, said combustor operable with fuel supplied only to said trapped vortex cavity when the gas turbine engine operates below a predefined percentage of rated power engine power.

4. A combustor in accordance with claim 3 wherein said combustor further operable with fuel supplied to said at least two mixer assemblies and said trapped vortex when the gas turbine engine operates above a predefined percentage of rated engine power.

5. A combustor in accordance with claim 1 further comprising at least two trapped vortex cavities, a first of said two fuel stages configured to supply fuel to said two trapped vortex cavities.

6. A combustor in accordance with claim 1 further comprising at least two trapped vortex cavities, said at least two mixer assemblies radially inward from said two vortex cavities.

7. A combustor in accordance with claim 1 further comprising a combustor liner radially outward from said at least two mixer assemblies, said combustor liner comprising an outer liner and an inner liner.

8. A combustor in accordance with claim 7 wherein said at least one trapped vortex defined by a portion of said combustor outer liner.

9. A gas turbine engine comprising a combustor comprising a fuel system, a diffuser, at least one trapped vortex cavity, and a plurality of mixer assemblies downstream from said diffuser, said fuel system comprising at least a first stage and a second stage, said first stage configured to supply fuel to said trapped vortex cavity, said second stage configured to supply fuel to said plurality of mixer assemblies.

10. A gas turbine engine in accordance with claim 9 wherein said fuel system further comprises at least one fuel injector configured to supply fuel to said trapped vortex cavity and said plurality of mixer assemblies.

11. A gas turbine engine in accordance with claim 9 wherein said gas turbine engine includes a rated power, said fuel system further comprising a pilot fuel circuit and a main fuel circuit, said combustor operable with fuel supplied only to said trapped vortex cavity when said gas turbine engine operates below a predefined percentage of rated engine power.

12. A gas turbine engine in accordance with claim 9 wherein said combustor further comprises at least two trapped vortex cavities, said fuel system first stage configured to supply to said two trapped vortex cavities.

13. A gas turbine engine in accordance with claim 9 wherein said combustor further comprises at least two trapped vortex cavities, said plurality of mixer assemblies radially inward from said two vortex cavities.

14. A gas turbine engine in accordance with claim 9 wherein said combustor further comprises a combustor liner radially outward from said at least plurality of mixer assemblies, said combustor liner comprising an outer liner and an inner liner, said at least one trapped vortex defined by a portion of said combustor outer liner.

* * * * *